US008641003B2

(12) United States Patent
Fernandez et al.

(10) Patent No.: US 8,641,003 B2
(45) **Date of Patent: *Feb. 4, 2014**

(54) SHELVING END BRACKETS WITH INTERCHANGEABLE PIECES FOR SUPPORTING HANG RODS OF DIFFERENT SIZES

(75) Inventors: Julio A. Fernandez, Doonnellon, FL (US); Robert P. Kundinger, Jr., Deland, FL (US)

(73) Assignee: Clairson, Inc., Newark, DE (US)

( * ) Notice: Subject to any disclaimer, the term of this patent is extended or adjusted under 35 U.S.C. 154(b) by 26 days.

This patent is subject to a terminal disclaimer.

(21) Appl. No.: 13/404,504

(22) Filed: Feb. 24, 2012

(65) Prior Publication Data

US 2012/0145661 A1 Jun. 14, 2012

Related U.S. Application Data

(63) Continuation of application No. 12/557,489, filed on Sep. 10, 2009, now Pat. No. 8,132,768, which is a continuation-in-part of application No. 29/340,614, filed on Jul. 22, 2009, now Pat. No. Des. 604,152, which is a continuation-in-part of application No. 29/340,615, filed on Jul. 22, 2009, now Pat. No. Des. 606,386, which is a continuation-in-part of application No. 29/340,616, filed on Jul. 22, 2009, now Pat. No. Des. 604,597, which is a continuation-in-part of application No. 29/340,617, filed on Jul. 22, 2009, now Pat. No. Des. 604,598.

(51) Int. Cl.
*A47H 1/14* (2006.01)

(52) U.S. Cl.
USPC ..... 248/254; 248/257

(58) Field of Classification Search
USPC ..... 211/105.1, 105.2, 123; 248/254, 255, 248/257, 262, 263, 235, 247, 248, 250
See application file for complete search history.

(56) References Cited

U.S. PATENT DOCUMENTS

| | | | |
|---|---|---|---|
| D5,634 | S | 3/1872 | Wunder |
| 1,006,328 | A | 10/1911 | Widenhofer |

(Continued)

FOREIGN PATENT DOCUMENTS

| | | | |
|---|---|---|---|
| EP | 0338872 | A1 | 10/1989 |
| FR | 2717994 | A1 | 10/1995 |

(Continued)

OTHER PUBLICATIONS http://www.closetmaid.com/Look/Product_Catalog/product.cfm?product_id=115, 2 pages, (c) 2006.

(Continued)

*Primary Examiner* — Alfred J Wujciak
(74) *Attorney, Agent, or Firm* — Harness, Dickey & Pierce, P.L.C.

(57) ABSTRACT

According to various aspects of the present disclosure, exemplary embodiments are disclosed of systems and methods for supporting hang rods and shelves from support surfaces, such as the walls of a closet or cabinet. In an exemplary embodiment, a system generally includes a pair of end brackets and a plurality of different pairs of interchangeable pieces configured to be selectively coupled to the pair of end brackets. Each pair of interchangeable pieces when selectively coupled to the end brackets, respectively, is operable for supporting a different hang rod from the support surface when the end brackets are coupled to the support surface.

8 Claims, 29 Drawing Sheets

(56) References Cited

U.S. PATENT DOCUMENTS

| | | | | |
|---|---|---|---|---|
| D78,426 | S | 4/1929 | Whincap | |
| 1,752,683 | A * | 4/1930 | Meagher | 248/251 |
| 1,793,036 | A | 2/1931 | Whitney | |
| 1,997,432 | A | 4/1935 | Replogle | |
| 2,020,991 | A | 11/1935 | Brody | |
| 2,057,429 | A | 10/1936 | Heim | |
| D108,811 | S | 3/1938 | Snyder | |
| 2,266,274 | A | 12/1941 | Schroeder | |
| 2,299,885 | A | 10/1942 | Ellsworth et al. | |
| 2,441,721 | A | 5/1948 | Schroeder | |
| 2,528,358 | A | 10/1950 | Grass | |
| 2,651,489 | A | 9/1953 | Bell | |
| 2,683,890 | A | 7/1954 | Rosenbaum | |
| 2,683,891 | A | 7/1954 | Rosenbaum | |
| 2,767,951 | A | 10/1956 | Cousino | |
| 2,809,002 | A | 10/1957 | Rudolph | |
| D189,163 | S | 11/1960 | Growe | |
| 3,221,894 | A | 12/1965 | Knuth | |
| 3,263,951 | A | 8/1966 | Stokes | |
| 3,410,231 | A | 11/1968 | Fletcher | |
| 3,476,008 | A | 11/1969 | Pearson et al. | |
| 3,499,541 | A | 3/1970 | Mackie | |
| 3,563,182 | A | 2/1971 | MacFarlane et al. | |
| 3,621,751 | A | 11/1971 | Fiorentino | |
| 3,640,389 | A | 2/1972 | Snyder | |
| D227,742 | S | 7/1973 | Logsdon | |
| 3,756,115 | A | 9/1973 | Schuplin | |
| 3,760,744 | A | 9/1973 | Cruckshank | |
| D228,852 | S | 10/1973 | Vogelhuber et al. | |
| 3,865,336 | A * | 2/1975 | Robertson | 248/235 |
| D240,502 | S | 7/1976 | Daniels | |
| 3,978,799 | A | 9/1976 | Escalette | |
| 3,998,170 | A | 12/1976 | Gordon | |
| D244,668 | S | 6/1977 | Tegner | |
| 4,098,480 | A | 7/1978 | Neumann | |
| 4,125,050 | A | 11/1978 | Schwartzman et al. | |
| 4,155,312 | A | 5/1979 | Thorkildson | |
| 4,209,111 | A | 6/1980 | Lotspeich et al. | |
| D258,489 | S | 3/1981 | Gipson | |
| 4,523,722 | A | 6/1985 | Cohen et al. | |
| D279,959 | S | 8/1985 | Nimmo et al. | |
| 4,533,056 | A | 8/1985 | Krikorian | |
| 4,548,327 | A | 10/1985 | Kilkelly | |
| 4,603,781 | A | 8/1986 | Ryan, Jr. | |
| D288,528 | S | 3/1987 | Parad | |
| 4,646,998 | A | 3/1987 | Pate | |
| D289,605 | S | 5/1987 | Lytle | |
| 4,671,419 | A | 6/1987 | Beverly | |
| D291,646 | S | 9/1987 | Koziol | |
| 4,693,380 | A | 9/1987 | Muth | |
| 4,708,552 | A | 11/1987 | Bustos et al. | |
| D293,416 | S | 12/1987 | Krueger | |
| 4,720,016 | A | 1/1988 | Kay | |
| 4,728,238 | A | 3/1988 | Chisholm et al. | |
| 4,732,284 | A | 3/1988 | Remmers | |
| D295,182 | S | 4/1988 | Remmers | |
| 4,735,325 | A | 4/1988 | Remmers | |
| D295,472 | S | 5/1988 | Remmers | |
| 4,749,159 | A | 6/1988 | Hoff | |
| 4,781,349 | A | 11/1988 | Remmers | |
| 4,783,035 | A | 11/1988 | Remmers | |
| D298,801 | S | 12/1988 | Satoh | |
| D299,212 | S | 1/1989 | Murphy | |
| D299,436 | S | 1/1989 | Muth | |
| 4,795,041 | A | 1/1989 | Remmers | |
| 4,838,451 | A | 6/1989 | Arkell et al. | |
| D305,272 | S | 12/1989 | Remmers | |
| 4,890,839 | A | 1/1990 | Ayotte | |
| D310,623 | S | 9/1990 | Aranibar | |
| D311,860 | S | 11/1990 | Remmers | |
| D312,389 | S | 11/1990 | Remmers | |
| 4,984,694 | A | 1/1991 | Magnusson | |
| D319,573 | S | 9/1991 | Rogers | |
| 5,074,223 | A | 12/1991 | Remmers | |
| D323,452 | S | 1/1992 | Stumpf et al. | |
| D323,715 | S | 2/1992 | Bodurow et al. | |
| 5,086,936 | A | 2/1992 | Remmers | |
| D326,603 | S | 6/1992 | Rogers | |
| D326,605 | S | 6/1992 | Nakanura | |
| 5,119,945 | A | 6/1992 | Wiggins | |
| 5,133,463 | A | 7/1992 | Merl | |
| D334,497 | S | 4/1993 | Putty | |
| D340,639 | S | 10/1993 | Remmers | |
| D342,015 | S | 12/1993 | Andrejew | |
| D348,826 | S | 7/1994 | McCaffrey | |
| 5,326,062 | A | 7/1994 | Remmers | |
| 5,330,063 | A | 7/1994 | Remmers | |
| 5,351,842 | A | 10/1994 | Remmers | |
| D353,500 | S | 12/1994 | Remmers | |
| 5,386,959 | A | 2/1995 | Laughlin et al. | |
| 5,407,084 | A | 4/1995 | Remmers | |
| 5,492,295 | A | 2/1996 | Remmers | |
| D369,293 | S | 4/1996 | Gusdorf et al. | |
| 5,531,416 | A | 7/1996 | Remmers | |
| 5,533,851 | A | 7/1996 | Remmers | |
| D373,719 | S | 9/1996 | Lin | |
| 5,580,018 | A | 12/1996 | Remmers | |
| 5,584,405 | A | 12/1996 | Tunzi | |
| 5,645,182 | A | 7/1997 | Miller, Jr. et al. | |
| D392,553 | S | 3/1998 | Dill | |
| 5,738,477 | A | 4/1998 | McCorkle et al. | |
| 5,752,610 | A | 5/1998 | Remmers | |
| 5,755,414 | A | 5/1998 | Remmers | |
| D394,999 | S | 6/1998 | Phillip | |
| 5,758,851 | A | 6/1998 | Remmers | |
| 5,788,093 | A | 8/1998 | Krut | |
| 5,833,193 | A | 11/1998 | Derda et al. | |
| D402,536 | S | 12/1998 | Cousins | |
| D403,234 | S | 12/1998 | Nagato | |
| D406,476 | S | 3/1999 | Boije | |
| D408,175 | S | 4/1999 | Daniels et al. | |
| D409,866 | S | 5/1999 | West | |
| D411,738 | S | 6/1999 | Raasch et al. | |
| 5,909,936 | A | 6/1999 | Daniels et al. | |
| 5,921,412 | A | 7/1999 | Merl | |
| 5,934,631 | A | 8/1999 | Becker et al. | |
| 6,053,465 | A | 4/2000 | Kluge | |
| D423,917 | S | 5/2000 | Remmers et al. | |
| D427,466 | S | 7/2000 | Remmers | |
| D437,515 | S | 2/2001 | Remmers et al. | |
| 6,189,527 | B1 | 2/2001 | Walsh et al. | |
| D443,456 | S | 6/2001 | Horsten | |
| 6,257,425 | B1 * | 7/2001 | Liu | 211/90.01 |
| 6,279,467 | B1 | 8/2001 | Tiemann | |
| 6,402,108 | B1 | 6/2002 | Remmers | |
| 6,443,318 | B1 | 9/2002 | Welsch | |
| 6,457,594 | B1 | 10/2002 | Tiemann | |
| 6,467,860 | B2 | 10/2002 | Remmers | |
| 6,494,653 | B2 | 12/2002 | Remmers | |
| D470,398 | S | 2/2003 | Remmers | |
| D477,144 | S | 7/2003 | Remmers | |
| D478,801 | S | 8/2003 | Spruill | |
| 6,626,509 | B2 | 9/2003 | Remmers | |
| D482,601 | S | 11/2003 | Chen | |
| 6,669,154 | B1 | 12/2003 | Remmers | |
| D484,779 | S | 1/2004 | Shibuya | |
| D485,109 | S | 1/2004 | Oberhaus | |
| D490,690 | S | 6/2004 | Brass et al. | |
| D497,738 | S | 11/2004 | Sparkowski | |
| 6,840,593 | B2 | 1/2005 | Remmers | |
| D506,385 | S | 6/2005 | Brown | |
| 6,915,913 | B2 | 7/2005 | Cardinell | |
| 6,953,176 | B2 | 10/2005 | Remmers | |
| 6,969,036 | B2 | 11/2005 | Magnusson | |
| D513,970 | S | 1/2006 | Sterling et al. | |
| 7,004,335 | B2 | 2/2006 | Remmers | |
| 7,021,730 | B2 | 4/2006 | Remmers | |
| D522,848 | S | 6/2006 | Nawrocki | |
| D522,852 | S | 6/2006 | Nawrocki | |
| D523,327 | S | 6/2006 | Clarke | |
| 7,063,491 | B2 | 6/2006 | French | |
| D525,115 | S | 7/2006 | Harwanko | |
| D525,811 | S | 8/2006 | Nawrocki | |
| D526,519 | S | 8/2006 | Nawrocki | |

(56) References Cited

U.S. PATENT DOCUMENTS

| | | | | |
|---|---|---|---|---|
| D526,887 | S | 8/2006 | Remmers et al. | |
| 7,086,543 | B2 | 8/2006 | Remmers | |
| 7,090,317 | B2 | 8/2006 | Remmers | |
| D527,559 | S | 9/2006 | Remmers | |
| D527,935 | S | 9/2006 | Remmers | |
| 7,104,411 | B2 | 9/2006 | Magnusson et al. | |
| D531,019 | S | 10/2006 | Plumer | |
| 7,121,417 | B2 | 10/2006 | Magnusson et al. | |
| D531,891 | S | 11/2006 | Nawrocki | |
| 7,174,605 | B1 | 2/2007 | Nawrocki | |
| 7,178,769 | B2 | 2/2007 | Magnusson et al. | |
| 7,185,772 | B2 | 3/2007 | Remmers | |
| 7,188,740 | B2 | 3/2007 | Marchetta et al. | |
| D543,094 | S | 5/2007 | Remmers | |
| 7,225,237 | B1 | 5/2007 | Tenereillo | |
| D544,260 | S | 6/2007 | Nawrocki | |
| D544,261 | S | 6/2007 | Nawrocki | |
| D547,163 | S | 7/2007 | Xayoiphonh | |
| D547,164 | S | 7/2007 | Xayoiphonh | |
| D547,640 | S | 7/2007 | Remmers | |
| 7,240,803 | B2 | 7/2007 | Stitchick et al. | |
| D550,072 | S | 9/2007 | Ardern | |
| D550,540 | S | 9/2007 | Nawrocki | |
| D551,062 | S | 9/2007 | Nawrocki | |
| D551,884 | S | 10/2007 | Remmers | |
| D553,485 | S | 10/2007 | Hall | |
| 7,296,697 | B2 | 11/2007 | Costa et al. | |
| D559,090 | S | 1/2008 | Nawrocki | |
| 7,314,144 | B2 | 1/2008 | Stitchick et al. | |
| D562,670 | S | 2/2008 | Rogers et al. | |
| D567,074 | S | 4/2008 | Gallien | |
| 7,407,060 | B2 * | 8/2008 | Swartz et al. | 211/94.01 |
| D581,776 | S | 12/2008 | Yin-Feng | |
| 7,458,548 | B2 | 12/2008 | Franzone et al. | |
| D590,240 | S | 4/2009 | Hutter, III | |
| D604,152 | S | 11/2009 | Fernandez et al. | |
| D604,597 | S | 11/2009 | Fernandez et al. | |
| D604,598 | S | 11/2009 | Fernandez et al. | |
| D606,386 | S | 12/2009 | Fernandez et al. | |
| D609,081 | S | 2/2010 | Gulley | |
| 7,832,573 | B2 | 11/2010 | Magnusson et al. | |
| D631,734 | S | 2/2011 | Fernandez et al. | |
| 8,132,768 | B2 * | 3/2012 | Fernandez et al. | 248/254 |
| 2002/0090278 | A1 | 7/2002 | Lai | |
| 2002/0153335 | A1 | 10/2002 | Robideau | |
| 2002/0166934 | A1 | 11/2002 | Marsh | |
| 2003/0231941 | A1 | 12/2003 | Kenny | |
| 2005/0109720 | A1 | 5/2005 | Marchetta | |
| 2005/0145147 | A1 | 7/2005 | Costa et al. | |
| 2005/0148942 | A1 | 7/2005 | Newby et al. | |
| 2005/0247651 | A1 | 11/2005 | Craft | |
| 2006/0011568 | A1 | 1/2006 | Remmers et al. | |
| 2006/0113443 | A1 | 6/2006 | Remmers | |
| 2006/0130983 | A1 | 6/2006 | Nien | |
| 2006/0175495 | A1 | 8/2006 | Gregory | |
| 2007/0023374 | A1 | 2/2007 | Nawrocki | |
| 2007/0068887 | A1 | 3/2007 | Nawrocki | |
| 2007/0101545 | A1 | 5/2007 | Nawrocki | |
| 2007/0102604 | A1 | 5/2007 | Nawrocki | |
| 2007/0108146 | A1 | 5/2007 | Nawrocki | |
| 2007/0108148 | A1 | 5/2007 | Stitchick et al. | |
| 2007/0114197 | A1 | 5/2007 | Remmers | |
| 2007/0114348 | A1 | 5/2007 | Nawrocki | |
| 2007/0119805 | A1 | 5/2007 | Nawrocki | |
| 2007/0134072 | A1 | 6/2007 | Su | |
| 2007/0137417 | A1 | 6/2007 | Nawrocki et al. | |
| 2007/0159040 | A1 | 7/2007 | Fernandez et al. | |
| 2007/0187561 | A1 | 8/2007 | Xayoiphonh | |
| 2007/0205172 | A1 | 9/2007 | Stitchick et al. | |
| 2008/0047098 | A1 | 2/2008 | Nawrocki | |

FOREIGN PATENT DOCUMENTS

| | | | |
|---|---|---|---|
| GB | 2153205 | A | 8/1985 |
| GB | 2180141 | A | 3/1987 |
| GB | 2229625 | A | 10/1990 |
| JP | 10002663 | | 1/1998 |
| WO | WO02/26082 | | 4/2002 |
| WO | WO 2004/056236 | | 7/2004 |

OTHER PUBLICATIONS http://www.closetmaid.com/pdfs/ARCHITECT_SS.pdf, 2 pages, (c) 2005.

* cited by examiner

SHELVING END BRACKETS WITH INTERCHANGEABLE PIECES FOR SUPPORTING HANG RODS OF DIFFERENT SIZES

CROSS-REFERENCE TO RELATED APPLICATIONS

This application is a continuation of U.S. patent application Ser. No. 12/557,489 filed Sep. 10, 2009 (issuing Mar. 13, 2012 as U.S. Pat. No. 8,132,768), which, in turn, was a continuation-in-part of:

- U.S. Design patent application Ser. No. 29/340,614 filed Jul. 22, 2009 now U.S. D604,152 issued Nov. 11, 2009; and
- U.S. Design patent application Ser. No. 29/340,615 filed Jul. 22, 2009 now U.S. D606,386 issued Dec. 22, 2009; and
- U.S. Design patent application Ser. No. 29/340,616 filed Jul. 22, 2009 now U.S. D604,597 issued Nov. 24, 2009; and
- U.S. Design patent application Ser. No. 29/340,617 filed Jul. 22, 2009 now U.S. D604,598 issued Nov. 24, 2009.

The entire disclosures of each of the above-identified patent applications are incorporated herein by reference in their entirety.

FIELD

The present disclosure generally relates to shelving end brackets with interchangeable pieces for supporting hang rods of different sizes in cabinets, closets, and/or other storage systems.

BACKGROUND

This section provides background information related to the present disclosure which is not necessarily prior art.

Efficient and organized use of building space is very desirable, particularly with respect to storage or utility space in businesses, residential homes, and apartments. In particular, because of the limited or tight spaces in these locations, increasing the amount of useable space is very important. Likewise, providing ease in access and increased user convenience is important.

With respect to closet organization and the design of closet storage units, particularly for residential use, many different options are available including, for example, different sizes and shapes of shelves, different attachment and mounting members and different storage members (e.g., wire baskets, shoe-stands, tie/belt racks, hang rods, etc.). Ease in accessing stored items, such as clothing, is important. Further, ease in moving stored items to make room for other items or to access items not readily accessible, is likewise important. For example, hang rods may be supported beneath a shelf to provide for relatively easy movement of items along the hang rod, for example, sliding clothes on hangers.

SUMMARY

This section provides a general summary of the disclosure, and is not a comprehensive disclosure of its full scope or all of its features.

According to various aspects of the present disclosure, exemplary embodiments are disclosed of systems and methods for supporting hang rods and shelves from support surfaces, such as the walls of a closet or cabinet. In an exemplary embodiment, a system generally includes a pair of end brackets and a plurality of different pairs of interchangeable pieces configured to be selectively coupled to the pair of end brackets. Each pair of interchangeable pieces when selectively coupled to the end brackets, respectively, is operable for supporting a different hang rod from the support surface when the end brackets are coupled to the support surface.

In another exemplary embodiment, a system generally includes at least one end bracket and at least one piece configured to be coupled to the end bracket. The piece includes a cradle portion for supporting an end portion of a hang rod at least partially within the cradle portion.

Additional aspects provide methods relating to supporting a hang rod from a support surface. In an exemplary embodiment, a method generally includes selecting a pair of interchangeable pieces for supporting the hang rod, from a plurality of different pairs of interchangeable pieces. The plurality includes at least one pair of interchangeable pieces that is configured for supporting a different hang rod than at least one other pair of interchangeable pieces. The method also includes coupling the selected pair of interchangeable pieces to a pair of end brackets, respectively. The selected pair of interchangeable pieces may then be used for supporting a hang rod from a support surface when the pair of end brackets are coupled to the support surface.

Further aspects and features of the present disclosure will become apparent from the detailed description provided hereinafter. In addition, any one or more aspects of the present disclosure may be implemented individually or in any combination with any one or more of the other aspects of the present disclosure. It should be understood that the detailed description and specific examples, while indicating exemplary embodiments of the present disclosure, are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIG. 1 is an exploded perspective view illustrating an exemplary shelf, three hang rods with different diameters, two end brackets, and three pairs of interchangeable pieces, where each pair includes saddles or cradle portions (for receiving and supporting the ends of a hang rod therebetween) that are configured differently than the other pairs of interchangeable pieces so that each pair may support a different one of the three hang rods, according to exemplary embodiments;

Corresponding reference numerals indicate corresponding parts throughout the several views of the drawings.

DETAILED DESCRIPTION

Figure 1:
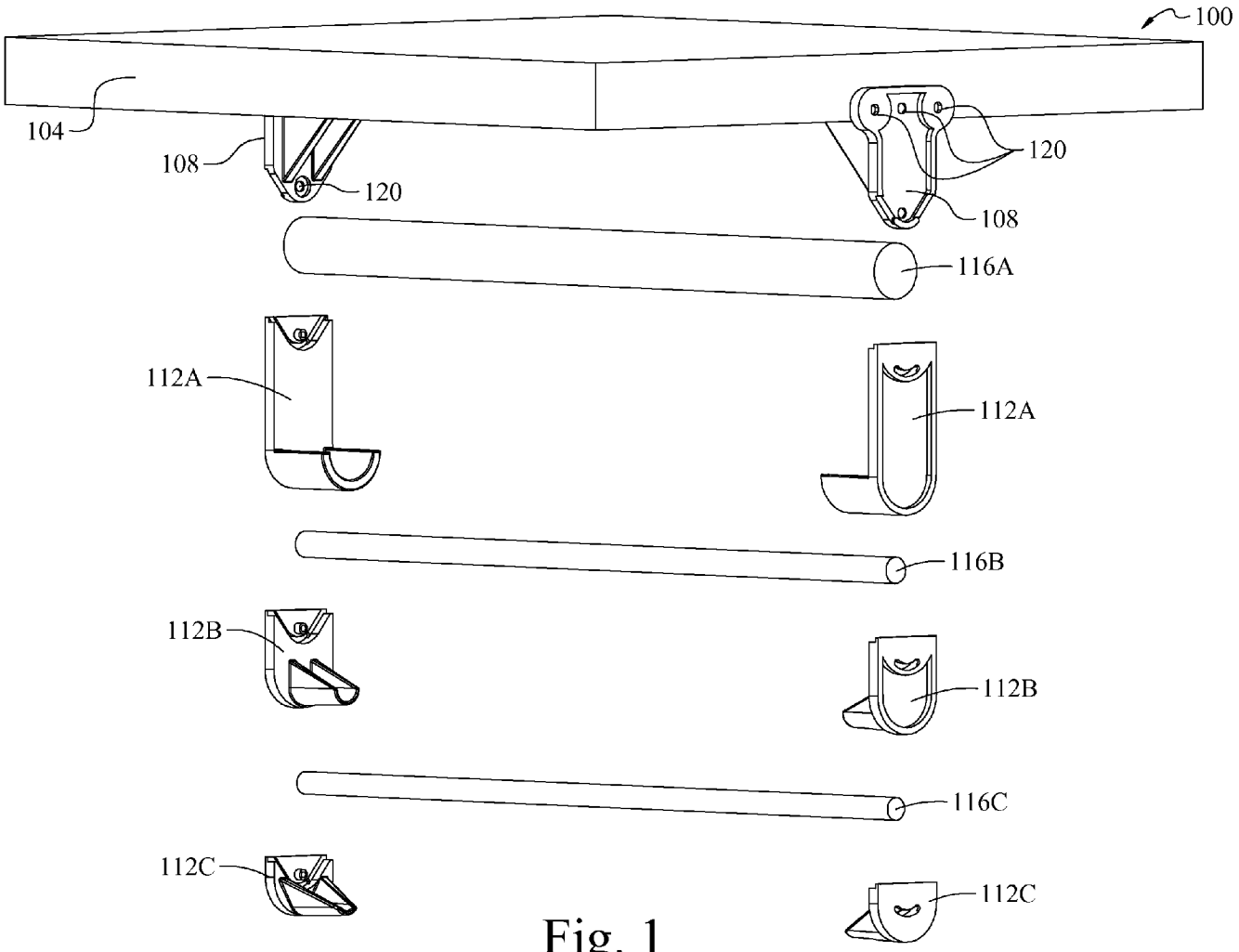

The following description is merely exemplary in nature and is in no way intended to limit the present disclosure, application, or uses.

According to various aspects of the present disclosure, exemplary embodiments are disclosed of systems and methods for supporting shelves and hang rods from support surfaces, such as the walls of a closet or cabinet, among other suitable surfaces associated with storage systems and areas. Generally, this disclosure relates to "universal" end bracket systems, which may include a pair of "common" end brackets and a plurality of pairs of different interchangeable pieces that may be coupled to the end brackets. In addition to being coupled to each other, the end brackets and/or interchangeable pieces may also be coupled, for example, with mechanical fasteners (e.g., nails, screws, etc.) to the walls of a closet or cabinet, etc. In such embodiments, the end brackets and/or interchangeable pieces may include one or more fastener holes, which may help guide the installer on where to position the mechanical fasters relative to the end brackets and/or interchangeable pieces.

The interchangeable pieces may allow the installer to convert/tailor the end brackets for use with a particular size of hang rod. As disclosed herein, each pair of interchangeable pieces may include saddles or cradle portions (for receiving and supporting the ends of a hang rod) that are configured differently (e.g., sized, shaped, etc.) than the saddles/cradle portions of the other pair(s) of interchangeable pieces. Accordingly, each pair may thus support a hang rod that has a different configuration (e.g., size, shape, etc.) than the hang rod(s) to be supported by the other pair(s) of interchangeable pieces.

A user may customize or tailor the pair of end brackets for use with a hang rod of a particular configuration (e.g., size, shape, etc.) by selecting (and then coupling to the end brackets) the particular pair of interchangeable pieces, which have the appropriately configured saddles or cradle portions for use with that certain hang rod.

Exemplary embodiments that include end brackets and interchangeable pieces may thus accommodate for hang rods of different diameters, shapes, etc. And, because the hang rod is supported from the ends thereof by the end brackets/interchangeable pieces, clothes hangers are able to freely slide along the entire length (or almost the entire length) of the hang rod without interference from the end brackets.

In addition to supporting a hang rod, the end brackets may also include a shelf support surface on which may be placed and supported at least a portion of shelf (e.g., laminate shelf, wooden shelf, wire ventilated shelf, etc.) By way of example, the end brackets may include triangular projections having upper surfaces that define shelf support surfaces. Alternatively, other embodiments may include end brackets with differently configured shelf support surfaces. Still further embodiments may include end brackets without any shelf support surfaces.

Referring now to FIG. 1, there is shown an exemplary embodiment of an adjustable shelving system or kit 100. As shown, the system 100 generally includes a shelf 104, end brackets 108, interchangeable pieces 112A, 112B, 112C, and hang rods 116A, 116B, 116C. The various components 104, 108, 112, and 116 of the adjustable shelving system 100 are described in more detail herein. In other embodiments, however, a shelving system may include any one or more (but not necessarily all) of the components 104, 108, 112, and 116, as the components 104, 108, 112, and 116 may be implemented individually or in any combination with any one or more of the other components and/or assemblies 104, 108, 112, and 116. For example, alternative embodiments may include the end brackets 108, only one pair of the interchangeable pieces 112A, 112B, or 112C, and only the corresponding one of the three hang rods 116A, 116B, or 116C. As another example embodiment, the system may be provided such that it only includes the end brackets 108, interchangeable pieces, 112A, 112B, 112C, and hang rods 116, 116B, 116C, without any shelf. Still further embodiments may include any number of end brackets, such as four end brackets such that the installer may install an end bracket adjacent each of the four corners of a shelf. Accordingly, aspects of the present disclosure also include the individual components themselves of the adjustable shelving systems disclosed herein. In addition, exemplary embodiments disclosed herein include systems and components thereof that may provide greater support and consumer flexibility to closet shelving arrangements.

Figure 2:
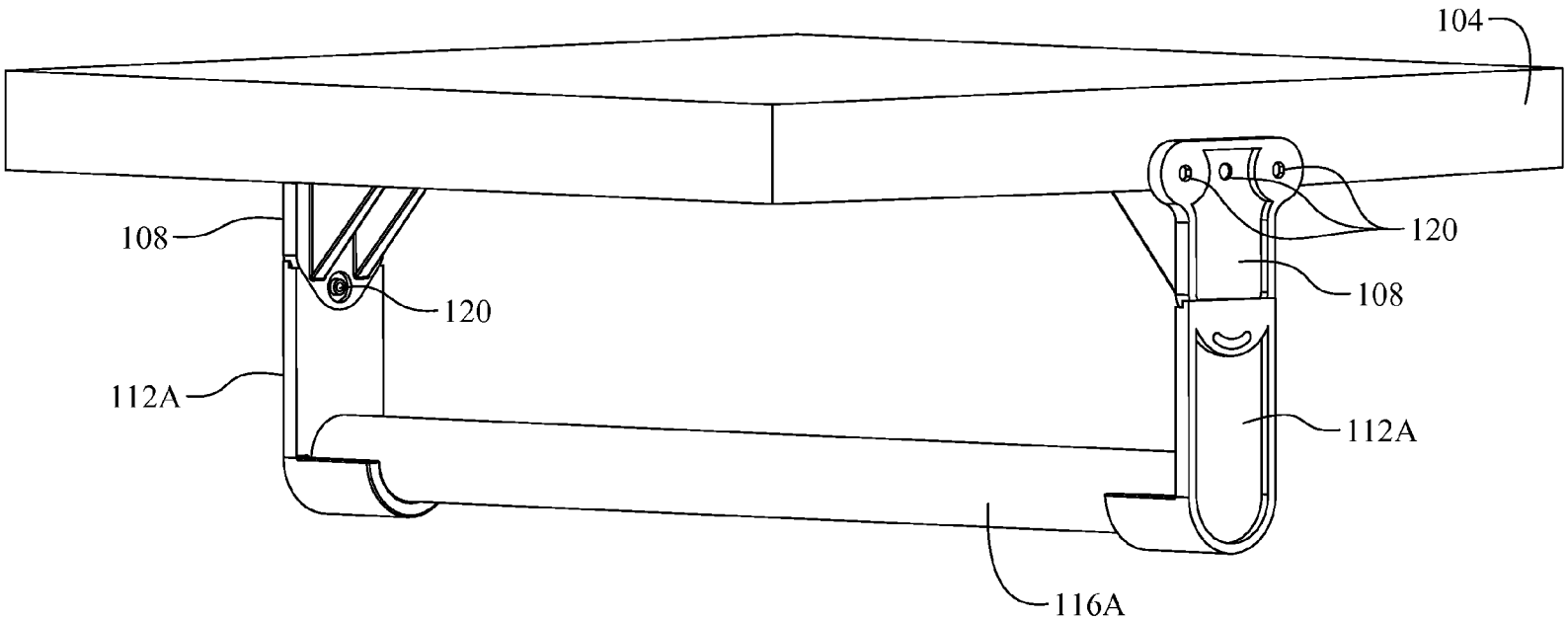
FIG. 2 is a perspective view illustrating the end brackets supporting the shelf thereon, where a first selected pair of the interchangeable pieces are coupled to the end brackets to thereby support the corresponding hang rod (having the largest diameter) below the shelf shown in FIG. 1.
Figure 3:
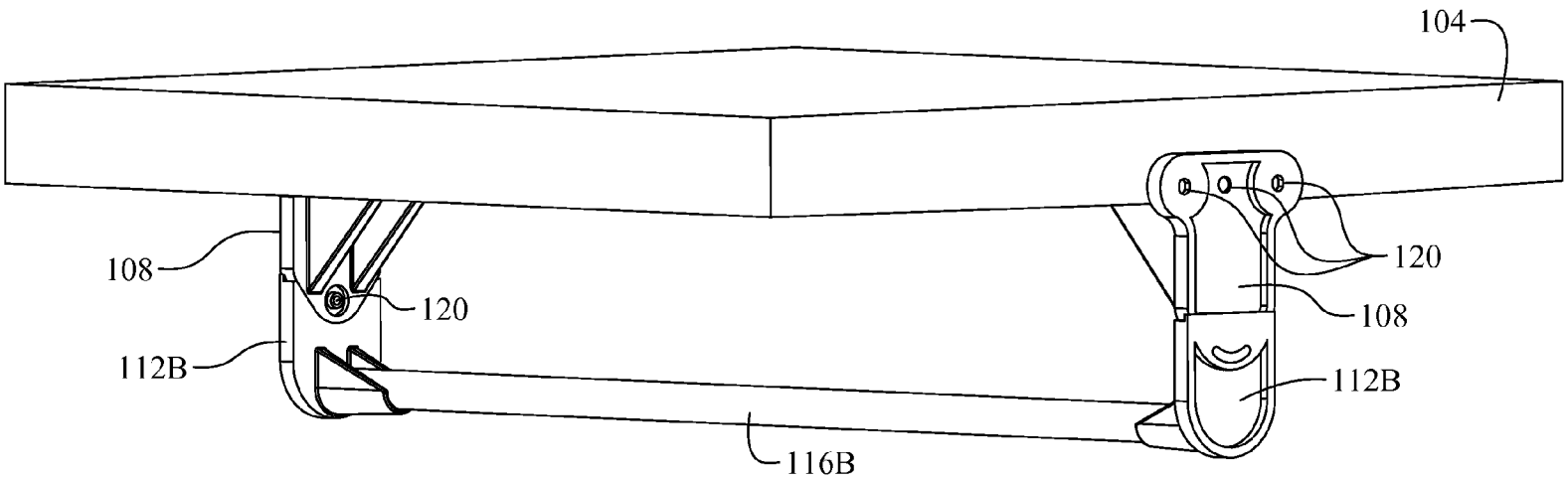
FIG. 3 is a perspective view illustrating the end brackets supporting the shelf thereon, where a second selected pair of the interchangeable pieces are coupled to the end brackets to thereby support the corresponding hang rod (having the intermediate diameter) below the shelf shown in FIG. 1.
Figure 4:
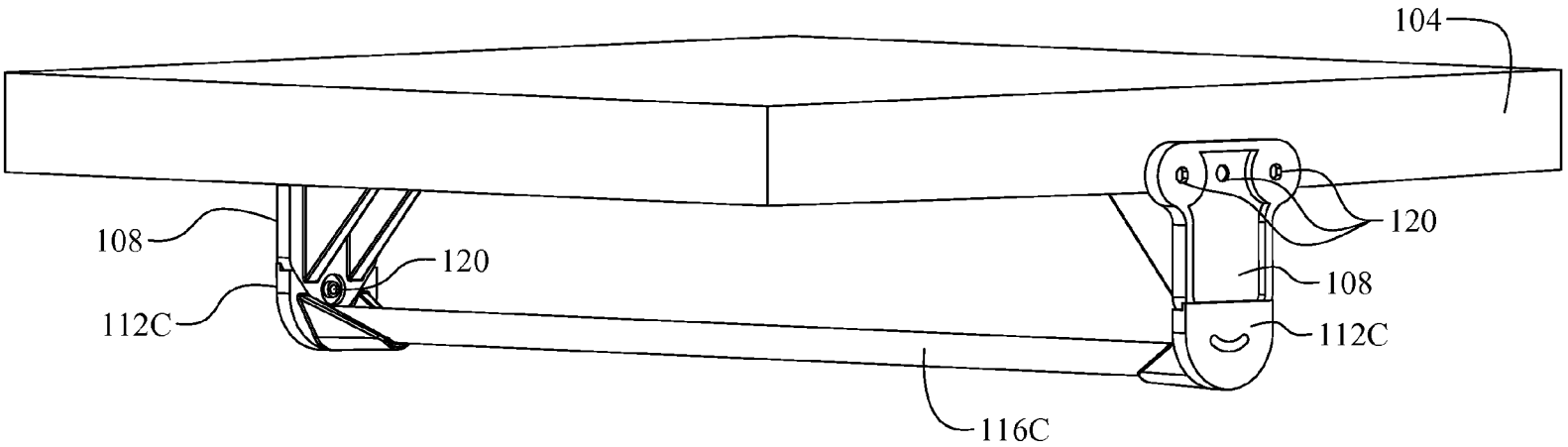
FIG. 4 is a perspective view illustrating the end brackets supporting the shelf thereon, where a third selected pair of the interchangeable pieces are coupled to the end brackets to thereby support the hang rod (having the smallest diameter) below the shelf shown in FIG. 1.

In some embodiments, some or all of these various components of the system 100 may be provided to or packaged as a kit for the end user, customer, or installer to thereby allow for selective installation of various components of the system 100. The installer may thus select which one of the hang rods to use and also then selectively install the corresponding pair of interchangeable pieces. For example, FIGS. 2, 3, and 4 respectively illustrate three different arrangements or selections that an installer may choose from a kit that includes the shelf 104, end brackets 108, interchangeable pieces 112A, 112B, 112C, and hang rods 116A, 116B, 116C. In FIGS. 2, 3, and 4, the mechanical fasteners have been omitted for clarity. But during the installation process, mechanical fasteners (e.g., nails, screws, etc.) may be inserted into one or more of fastener holes 120 to attach the end brackets 108 (and interchangeable pieces 112 coupled thereto) to a support surface, such as the walls of a closet or cabinet.

FIG. 2 illustrates the arrangement in which the installer has selectively installed the largest diameter hang rod 116A and corresponding pair of interchangeable pieces 112A. FIGS. 5 through 10 illustrate the exemplary manner (which is described in more detail below) by which the interchangeable piece 112A may be coupled to the end bracket 108 before attachment or fastening to a support surface like a closet wall.

FIG. 3 illustrates the arrangement in which the installer has selectively installed the intermediate diameter hang rod 116B and corresponding pair of interchangeable pieces 112B. FIGS. 26 through 31 illustrate the exemplary manner (which is described in more detail below) by which the interchangeable piece 112B may be coupled to the end bracket 108 before attachment or fastening to a support surface like a closet wall.

FIG. 4 illustrates the arrangement in which the installer has selectively installed the smallest diameter hang rod 116C and corresponding pair of interchangeable pieces 112C. FIGS. 40 through 45 illustrate the exemplary manner (which is described in more detail below) by which the interchangeable piece 112C may be coupled to the end bracket 108 before attachment or fastening to a support surface like a closet wall.

The end brackets 108 will now be described in detail with reference to FIGS. 5 through 17. Each end bracket 108 includes a pair of spaced-apart generally parallel triangular projections 124 extending generally outwardly from the back surface 128 of the end bracket 108. As shown in FIGS. 1 through 4, the upper surfaces 132 of the triangular projections 124 may be used for supporting a shelf 104 thereon. Accordingly, the surfaces 132 may also be referred to herein as shelf support surfaces, as they may be used for supporting any of a wide range of shelves, such as laminate shelves, wooden shelves, wire ventilated shelves, etc. Alternative embodiments may include end brackets with differently configured shelf support surfaces, such as support surfaces defined by non-triangular projections (e.g., rectangular, etc.) and/or more or less than two support surfaces. Still further embodiments may include end brackets with only one support surface or without any shelf support surfaces.

Figure 5:
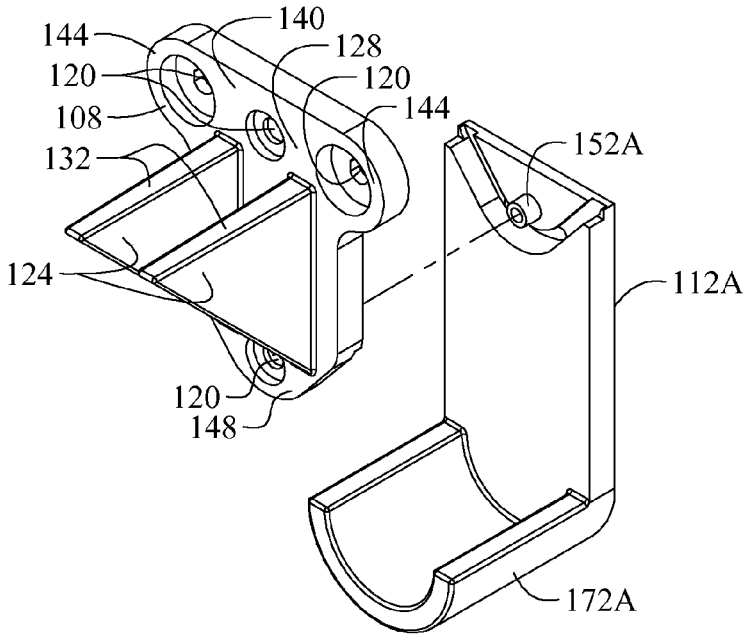
FIG. 5 is an upper front exploded perspective view illustrating one of the end brackets and interchangeable pieces shown in FIGS. 1 and 2.
Figure 6:
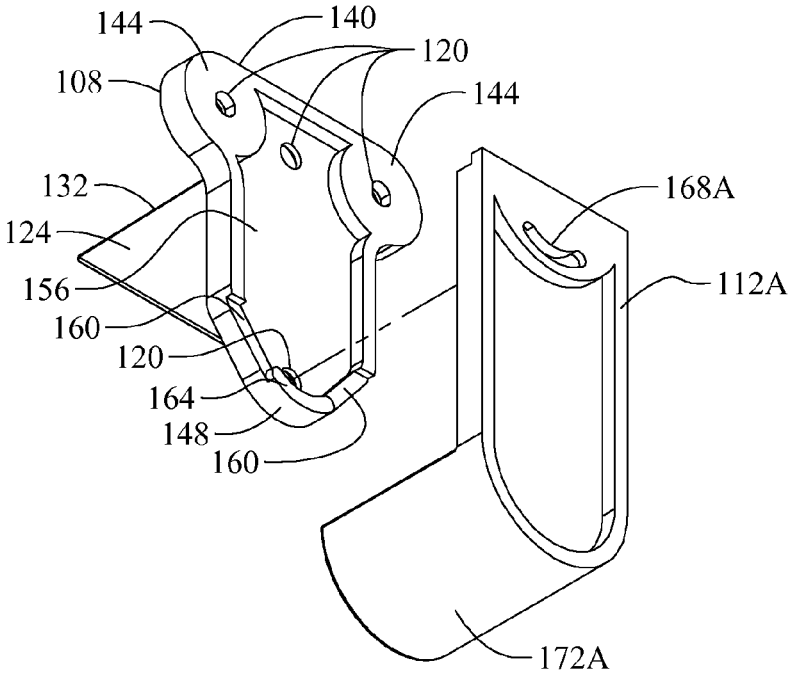
FIG. 6 is a lower back exploded perspective view of the end bracket and interchangeable piece shown in FIG. 5.
Figure 7:
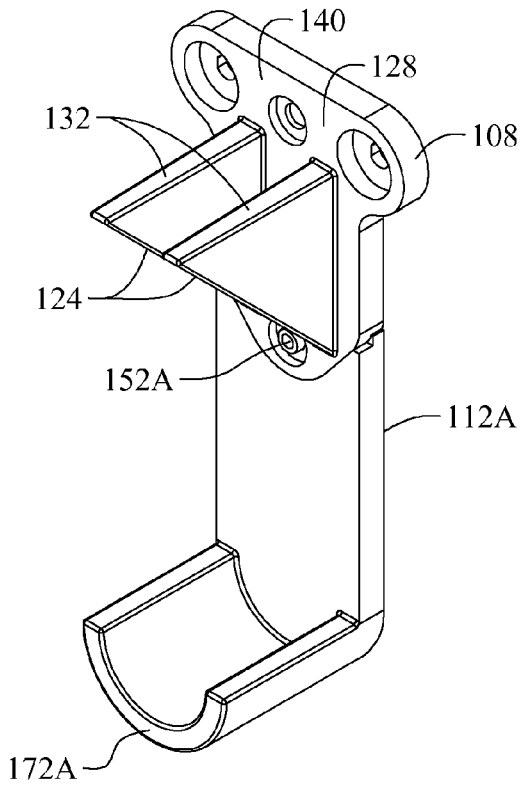
FIG. 7 is an upper front perspective view of the interchangeable piece coupled to the end bracket shown in FIG. 5.
Figure 8:
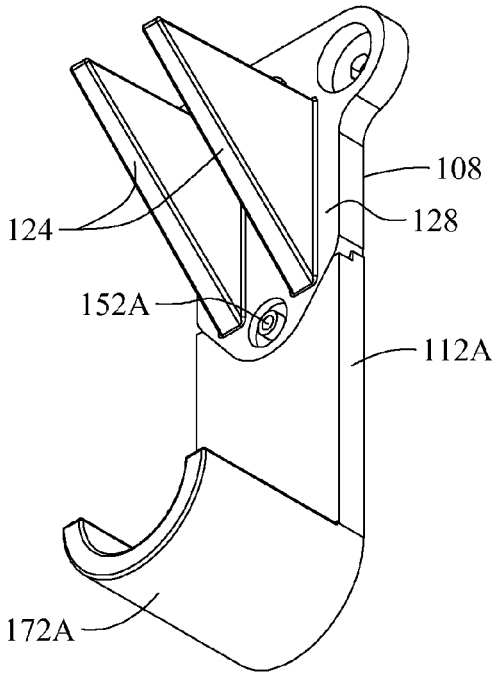
FIG. 8 is a lower front perspective view of the end bracket and interchangeable piece shown in FIG. 7.
Figure 9:
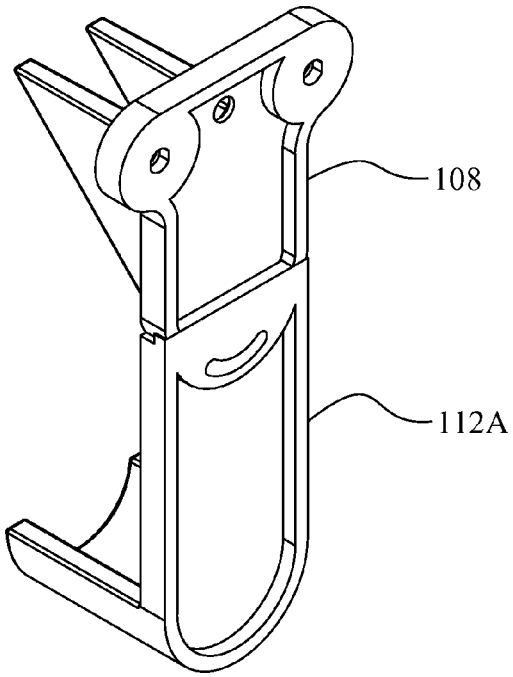
FIG. 9 is an upper back perspective view of the end bracket and interchangeable piece shown in FIG. 7.
Figure 10:
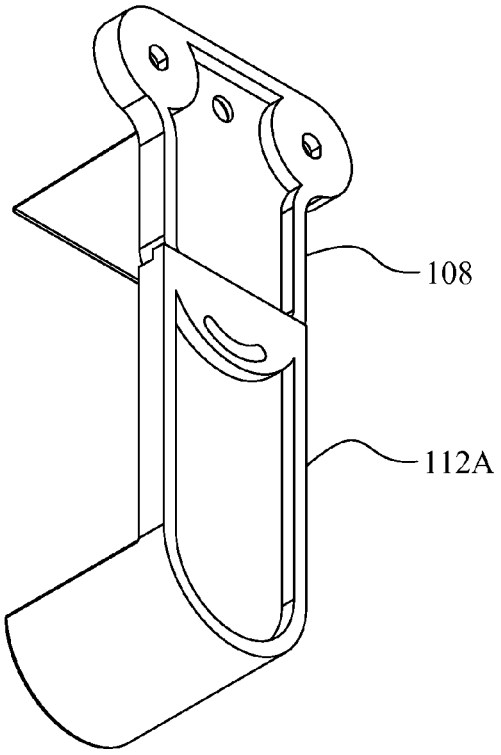
FIG. 10 is a lower back perspective view of the end bracket and interchangeable piece shown in FIG. 7.
Figure 11:
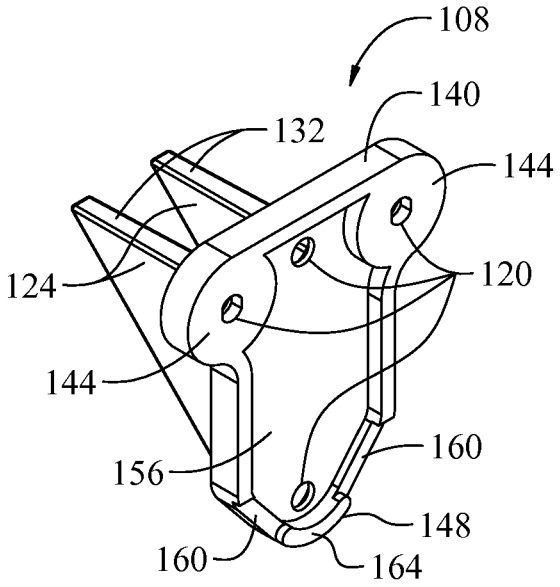
FIG. 11 is an upper back perspective view of the end bracket shown in FIG. 5.
Figure 12:
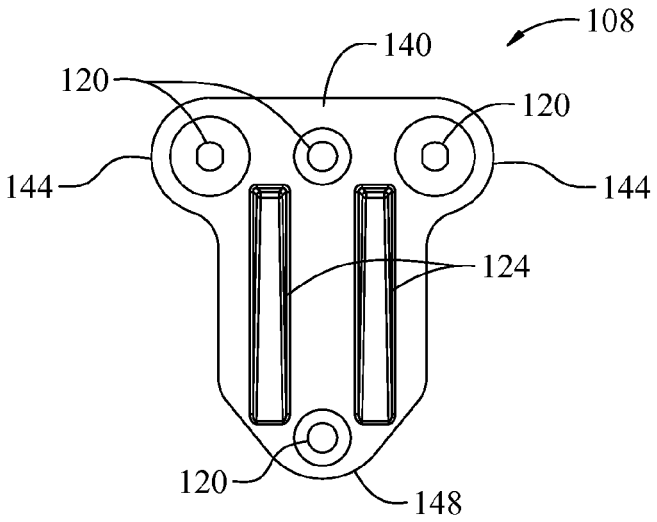
FIG. 12 is a front view of the end bracket shown in FIG. 11.
Figure 13:
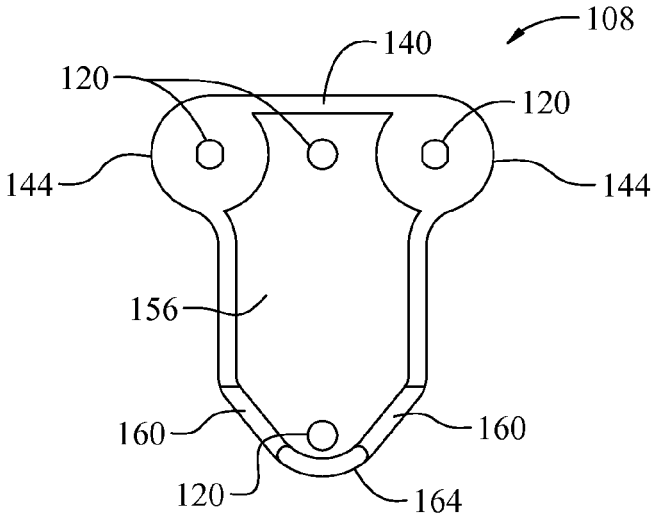
FIG. 13 is a back view of the end bracket shown in FIG. 11.
Figure 14:
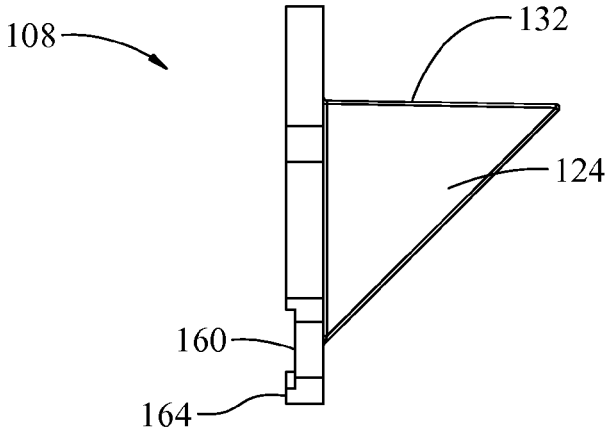
FIG. 14 is a left side view of the end bracket shown in FIG. 11.
Figure 15:
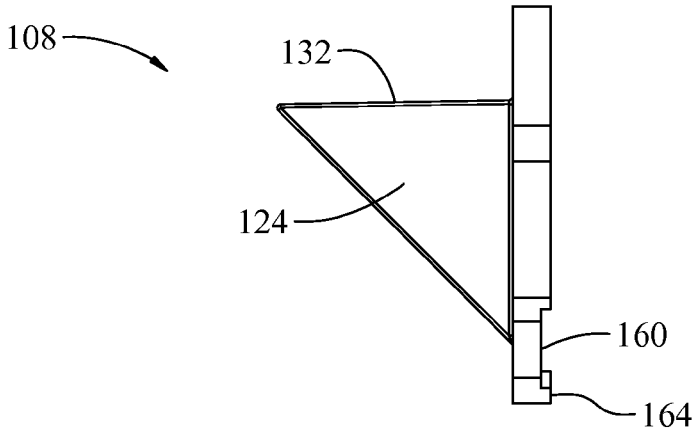
FIG. 15 is a right side view of the end bracket shown in FIG. 11.
Figure 16:
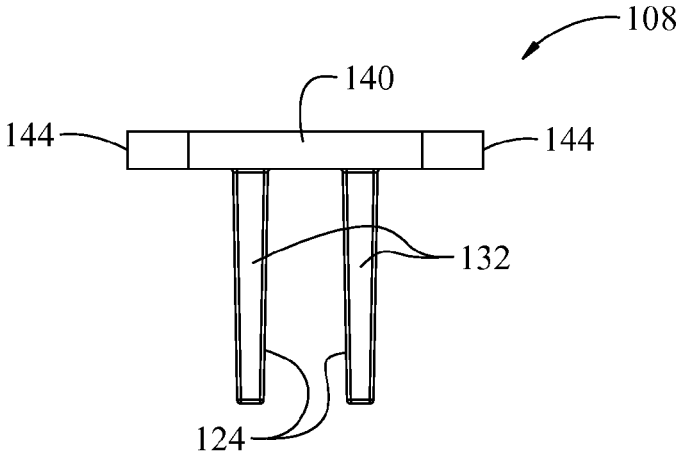
FIG. 16 is a top view of the end bracket shown in FIG. 11.
Figure 17:
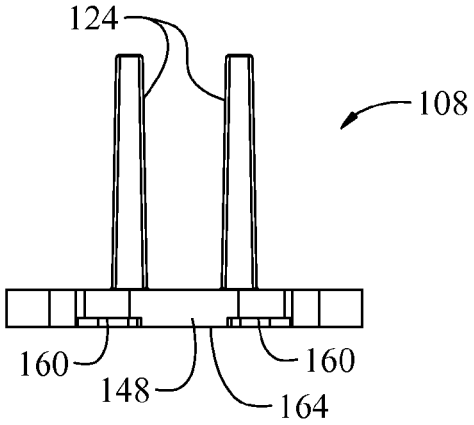
FIG. 17 is a bottom view of the end bracket shown in FIG. 11.

With continued reference to FIGS. 5 and 6, the illustrated end bracket 108 also includes holes 120. During the installation process, mechanical fasteners (e.g., nails, screws, etc.) may be inserted into the holes for attaching the end bracket 108 to the walls of a closet or cabinet, etc. In this exemplary embodiment, the end bracket 108 includes four countersunk holes 120. Three of the holes 120 are equally spaced apart and generally aligned horizontally with each other along the top portion 140 of the end bracket 108. The middle of the three top holes 120 is disposed at about the centerline axis of the end bracket 108, while the other two holes 120 are disposed within the respective rounded flange or ear portions 144 of the bracket 108. The fourth or bottom hole 120 is disposed towards the rounded bottom 148 of the end bracket 108. The bottom hole 120 is vertically aligned with the middle, top hole 120 generally along the bracket's centerline axis. The bottom hole 120 is also configured for receiving a projection or pin 152 of the interchangeable piece 112. Alternative embodiments may include a different fastener hole configuration, such as more or less than four holes, holes in different shapes, holes at different locations, holes that are not countersunk, etc. The holes 108 may also help guide the installer on where to position the mechanical fasters relative to the end bracket 108. In still further embodiment, the end bracket 108 may be configured without any fastener holes.

As shown in FIG. 6, the end bracket 108 includes a recessed back portion 156. This allows less material to be used to form the end bracket 108. Towards the bottom portion 148, the end bracket 108 includes two spaced-apart notches, recesses, or cut-outs 160 with a nub, tab, or protrusion 164 therebetween.

The end bracket's nub 164 is configured to be received within the curved groove or slot 168 of the interchangeable piece 112. The end bracket's notches 160 are configured to receive corresponding portions of the interchangeable piece 112. The end bracket 108 may thus be coupled to an interchangeable piece 112A, 112B, or 112C by way of the engagement of the interchangeable piece's pin 168 into the end bracket's bottom hole 120, the engagement of the end bracket's nub 164 into the interchangeable piece's groove 168, and the engagement of the corresponding portions of the interchangeable piece into the end bracket's notches 160. After coupling the end bracket 108 and interchangeable piece 112 in this manner, a more secure attachment between the end bracket 108 and interchangeable piece 112 may be accomplished via a mechanical fastener (e.g., nail, screw, etc.). The mechanical fastener may be inserted through the end bracket's bottom hole 120 and interchangeable piece's pin 168, and then the mechanical fastener may be driven (e.g., nailed, screwed, etc.) into a wall of closet or cabinet, etc.

The end bracket 108 may be coupled to any one of the three different interchangeable pieces 112A (FIGS. 5 through 10), 112B (FIGS. 26 through 31), 112C (FIGS. 40 through 45). By virtue of their different cradle or saddle portions 172A, 172B, 172C, the interchangeable pieces 112A, 112B, 112C allow the installer to convert/tailor the end bracket 108 for use with a particular hang rod. Each of the different saddles or cradle portions 172 is configured (e.g., sized, shaped, etc.) for receiving and supporting the end of particular hang rod 116 (FIG. 1) that is different than the hang rods to be supported by the other saddles or cradle portions.

Figure 18:
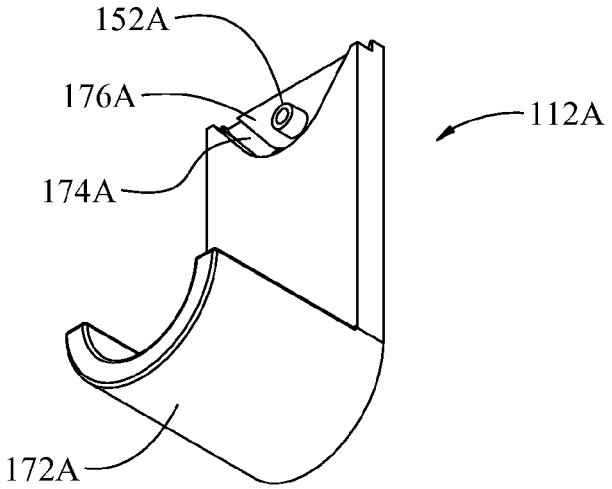
FIG. 18 is a lower front perspective view of the interchangeable piece shown in FIG. 5.
Figure 19:
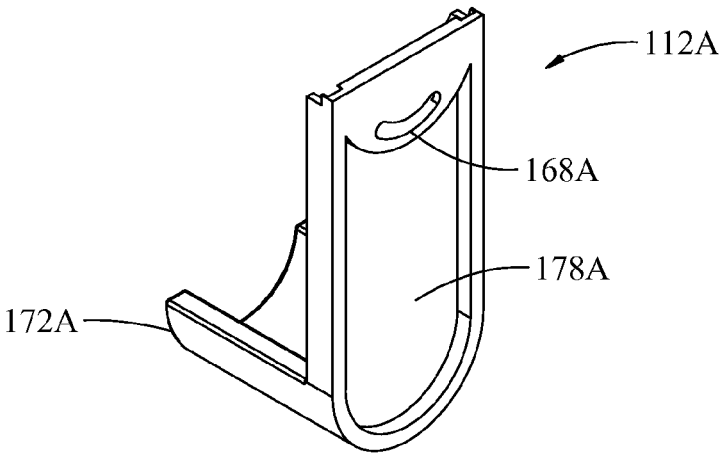
FIG. 19 is an upper back perspective view of the interchangeable piece shown in FIG. 18.
Figure 20:
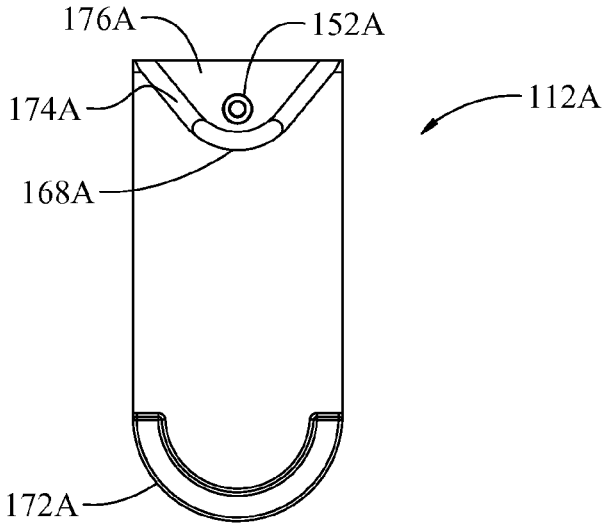
FIG. 20 is a front view of the interchangeable piece shown in FIG. 18.
Figure 21:
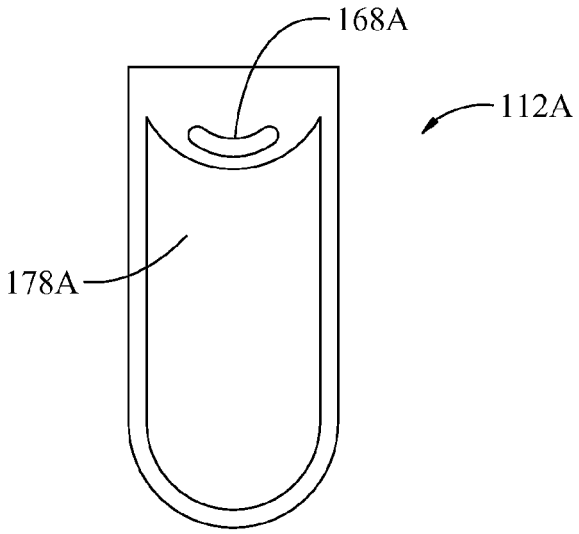
FIG. 21 is a back view of the interchangeable piece shown in FIG. 18.
Figure 22:
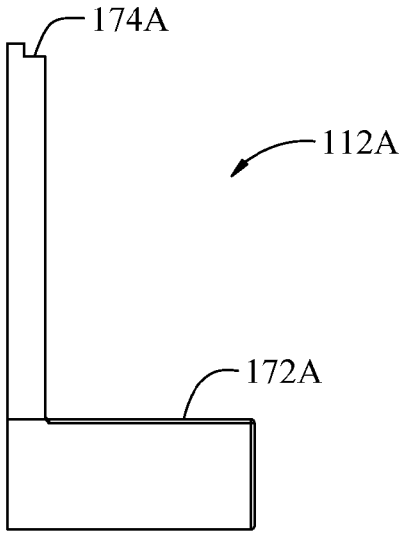
FIG. 22 is a left side view of the interchangeable piece shown in FIG. 18.
Figure 23:
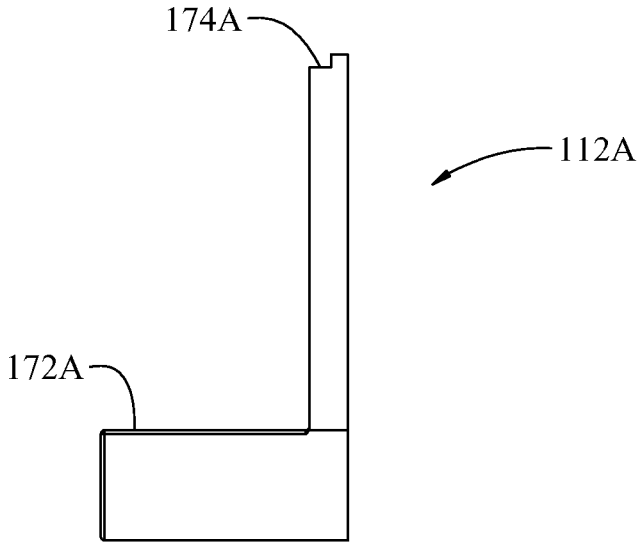
FIG. 23 is a right side view of the interchangeable piece shown in FIG. 18.
Figure 24:
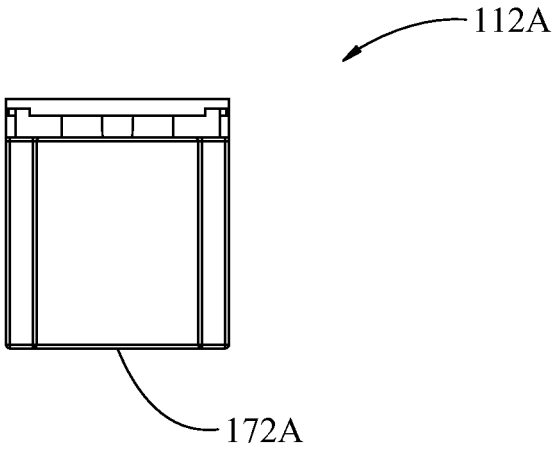
FIG. 24 is a top view of the interchangeable piece shown in FIG. 18.
Figure 25:
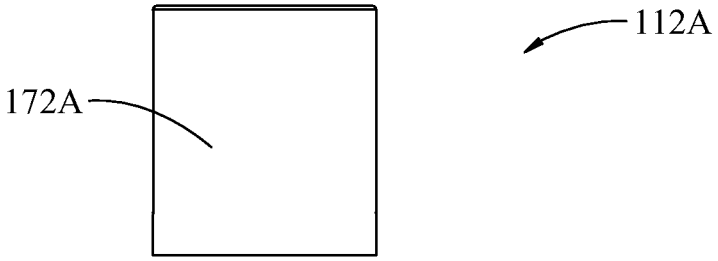
FIG. 25 is a back view of the interchangeable piece shown in FIG. 18.
Figure 26:
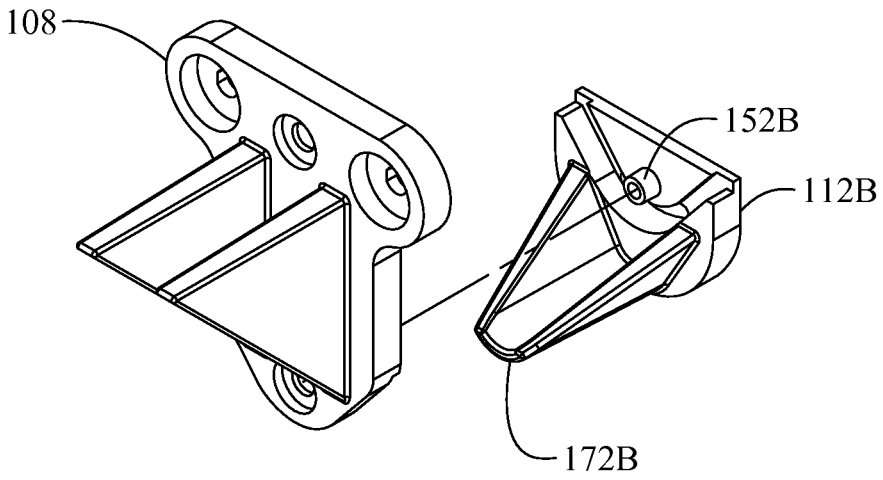
FIG. 26 is an upper front exploded perspective view illustrating one of the end brackets and interchangeable pieces shown in FIGS. 1 and 2.

Referring now to FIGS. 18 through 23, the interchangeable piece 112A will be described in further detail. The interchangeable piece 112A includes the pin 152A and groove 168A (FIGS. 18 and 20). As noted above, the pin 152A is configured to be received within the end bracket's bottom hole 120, and groove 168A is configured for receiving the end bracket's nub 164.

The interchangeable piece 112A includes a notched portion or groove 174A. The notched portion or groove 174A is shaped complementary to corresponding portions of the end bracket 108. The interchangeable piece 112A also includes a recessed upper portion 176A disposed generally within or interior to the groove 174A. The recessed upper portion 176A is shaped complementary to the lower rounded portion 148 of the end bracket 108. As shown in FIGS. 7 through 10, these complementary-shaped features allow the interchangeable piece 112A to be coupled to the end bracket 108 such that their back surfaces are flush or substantially aligned. In addition, these corresponding complementary-shaped portions of the end bracket 108 and interchangeable piece 112A may also help the installer align the interchangeable piece 112A when coupling to the end bracket 108 (e.g., by inserting the end bracket's nub 164 into the curved groove or slot 168A of the interchangeable piece 112A and inserting the interchangeable piece's pin 168A into the end bracket's bottom hole 120, etc.).

Figure 33:
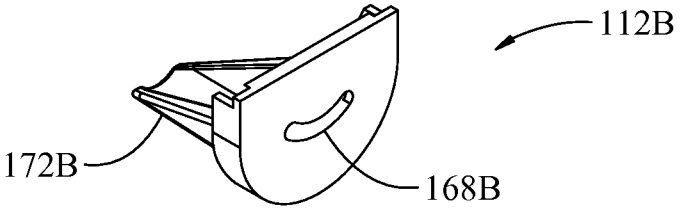
FIG. 33 is an upper back perspective view of the interchangeable piece shown in FIG. 32.
Figure 34:
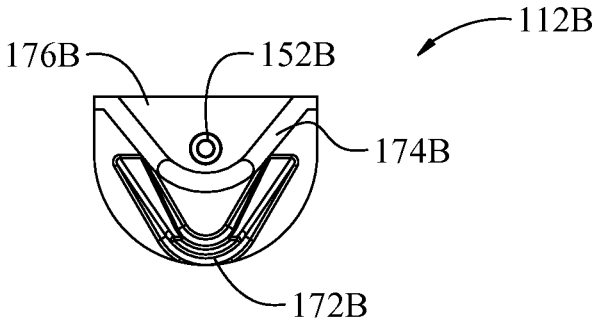
FIG. 34 is a front view of the interchangeable piece shown in FIG. 32.
Figure 35:
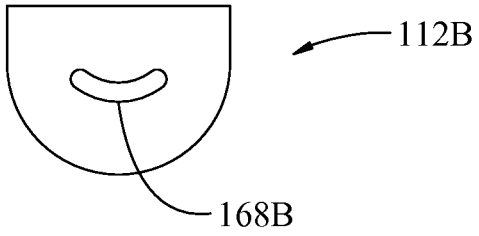
FIG. 35 is a back view of the interchangeable piece shown in FIG. 32.
Figure 36:
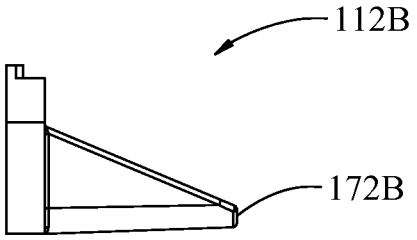
FIG. 36 is a left side view of the interchangeable piece shown in FIG. 32.
Figure 37:
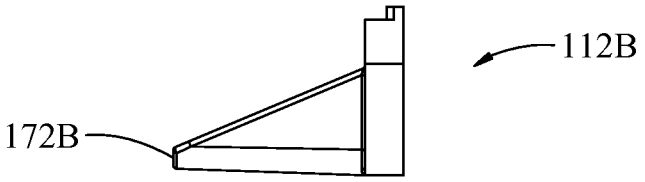
FIG. 37 is a right side view of the interchangeable piece shown in FIG. 32.
Figure 38:
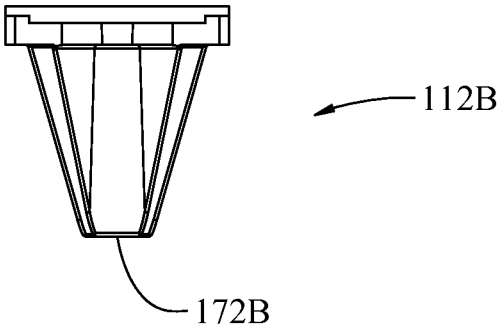
FIG. 38 is a top view of the interchangeable piece shown in FIG. 32.
Figure 39:
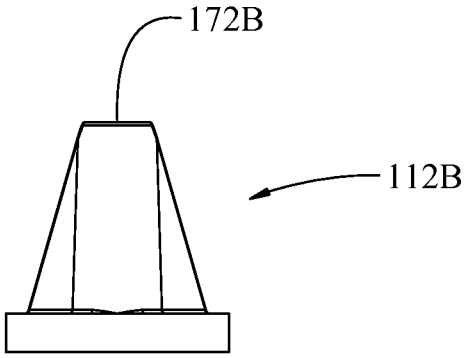
FIG. 39 is a back view of the interchangeable piece shown in FIG. 32.
Figure 40:
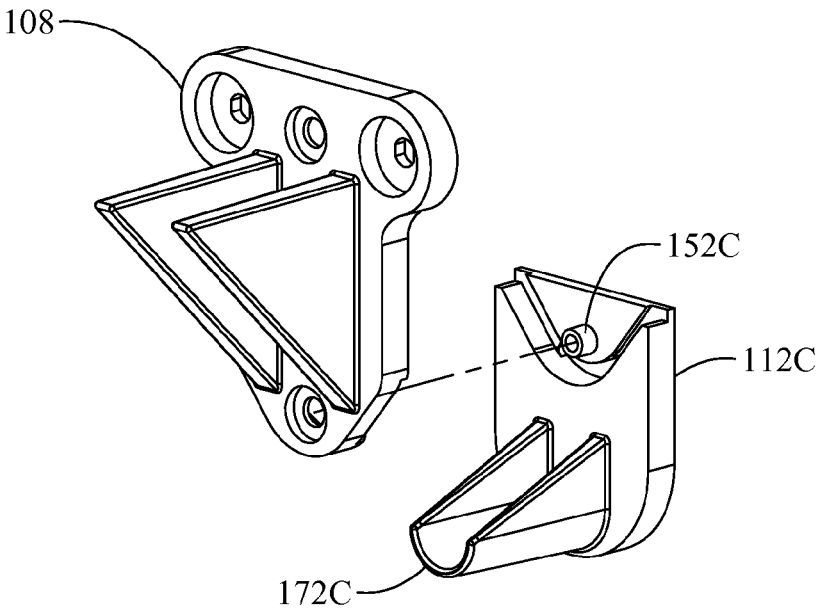
FIG. 40 is an upper front exploded perspective view illustrating one of the end brackets and interchangeable pieces shown in FIGS. 1 and 2.
Figure 41:
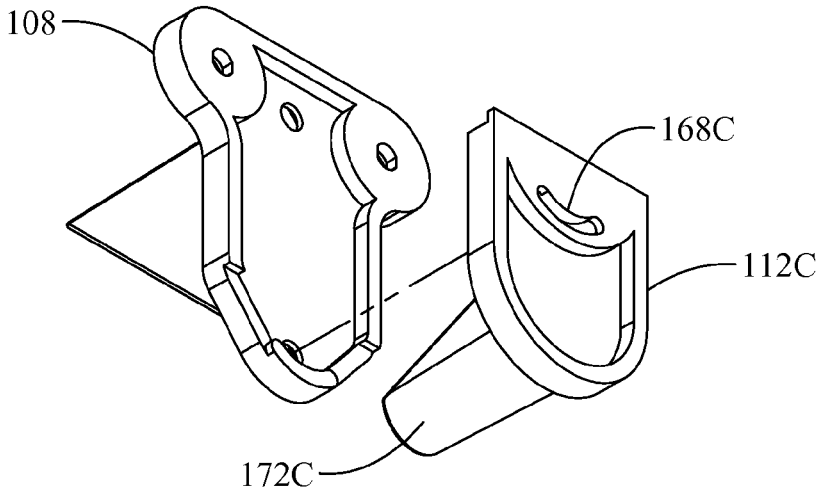
FIG. 41 is a lower back exploded perspective view of the end bracket and interchangeable piece shown in FIG. 40.
Figure 42:
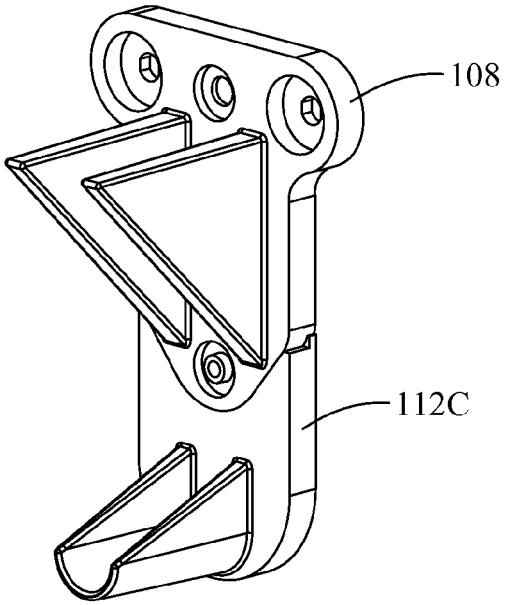
FIG. 42 is an upper front perspective view of the interchangeable piece coupled to the end bracket shown in FIG. 40.
Figure 43:
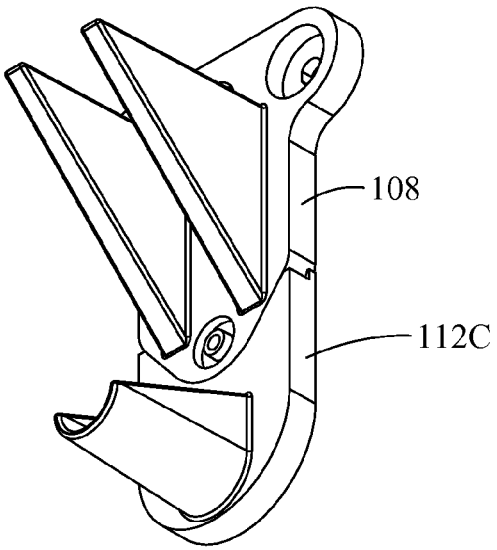
FIG. 43 is a lower front perspective view of the end bracket and interchangeable piece shown in FIG. 42.
Figure 44:
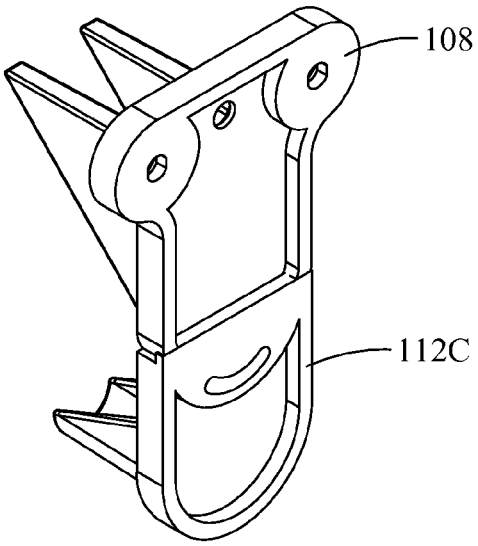
FIG. 44 is an upper back perspective view of the end bracket and interchangeable piece shown in FIG. 42.
Figure 45:
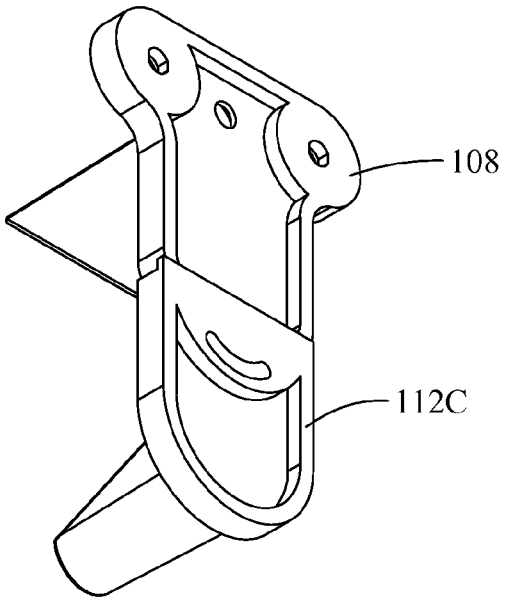
FIG. 45 is a lower back perspective view of the end bracket and interchangeable piece shown in FIG. 42.
Figure 46:
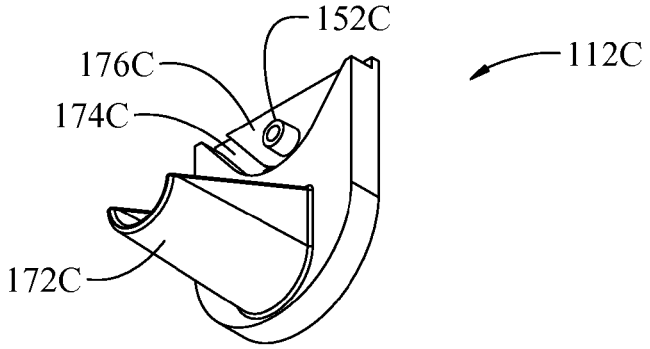
FIG. 46 is a lower front perspective view of the interchangeable piece shown in FIG. 42.

As shown in FIG. 19, the interchangeable piece 112A includes a recessed back portion 178A. This allows less material to be used to form the interchangeable piece 112A. In other embodiments, the interchangeable piece may include a back portion that is not recessed (see, for example, FIG. 33).

In the illustrated embodiment of FIGS. 18 through 23, the saddle or cradle portion 172A of the interchangeable piece 112A has a generally C-shaped or U-shaped profile when viewed from the end thereof. Accordingly, the saddle or cradle portion 172A is suitable for receiving and support an end portion of a hang rod having a circular cross section. In other embodiments, the saddle or cradle portion 172A may have a different configuration (e.g., different shape, different profile, different size, etc.) depending, for example, on the corresponding cross-sectional shape or size of the hang/hanger rod 116C to be supported thereby.

FIGS. 32 through 39 illustrate the second interchangeable piece 112B, which may be coupled to the end bracket 108. FIGS. 46 through 53 illustrate the third interchangeable piece 112C, which may be coupled to the end bracket 108. The second and third interchangeable pieces 112B, 112C include many of the same or similar features as the first interchangeable piece 112A, such that corresponding reference numerals (e.g., 112A, 112B, 112C) indicate corresponding parts throughout the several views of the drawings. But as noted earlier, the saddles or cradle portions 172A, 172B, and 172C are configured differently for use with different hang rods 116A, 116B, and 116C.

This notwithstanding, the second interchangeable piece 112B will now be described in further detail with reference to FIGS. 32 through 39. The second interchangeable piece 112B includes pin 152B and groove 168B. The pin 152B is configured to be received within the end bracket's bottom hole 120, and groove 168B is configured for receiving the end bracket's nub 164.

The interchangeable piece 112B includes a notched portion or groove 174B complementary in shape to corresponding portions of the end bracket 108. The interchangeable piece 112B also includes a recessed upper portion 176B disposed generally within or interior to the groove 174B. The recessed upper portion 176B is shaped complementary to the lower rounded portion 148 of the end bracket 108. As shown in FIGS. 26 through 29, these complementary-shaped features allow the interchangeable piece 112B to be coupled to the end bracket 108 such that their back surfaces are flush or substantially aligned. In addition, these corresponding complementary-shaped portions of the end bracket 108 and interchangeable piece 112B may also help the installer align the interchangeable piece 112B when coupling to the end bracket 108 (e.g., by inserting the end bracket's nub 164 into the curved groove or slot 168B of the interchangeable piece 112B and inserting the interchangeable piece's pin 168B into the end bracket's bottom hole 120, etc.).

Figure 27:
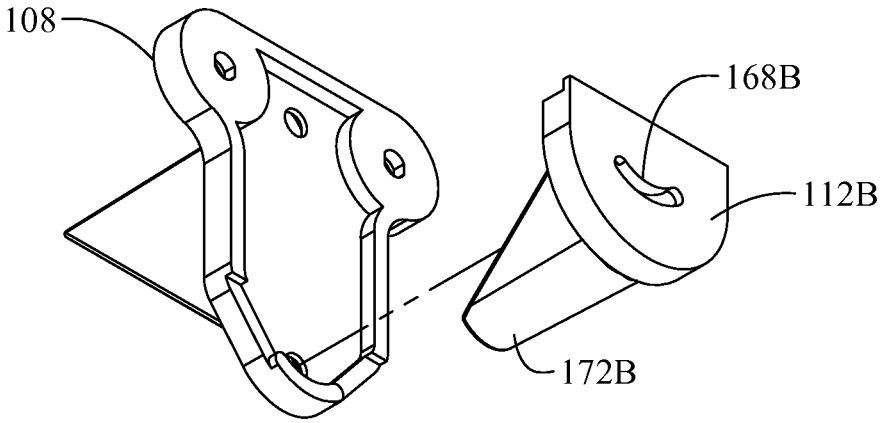
FIG. 27 is a lower back exploded perspective view of the end bracket and interchangeable piece shown in FIG. 26.
Figure 28:
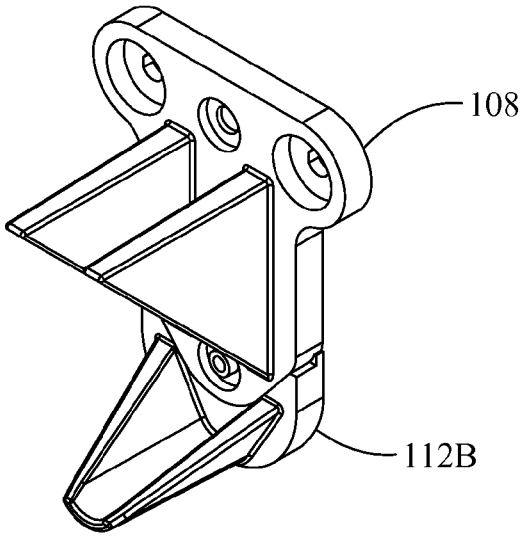
FIG. 28 is an upper front perspective view of the interchangeable piece coupled to the end bracket shown in FIG. 26.
Figure 29:
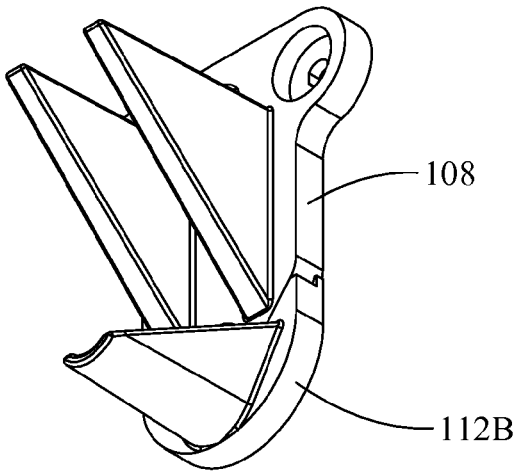
FIG. 29 is a lower front perspective view of the end bracket and interchangeable piece shown in FIG. 28.
Figure 30:
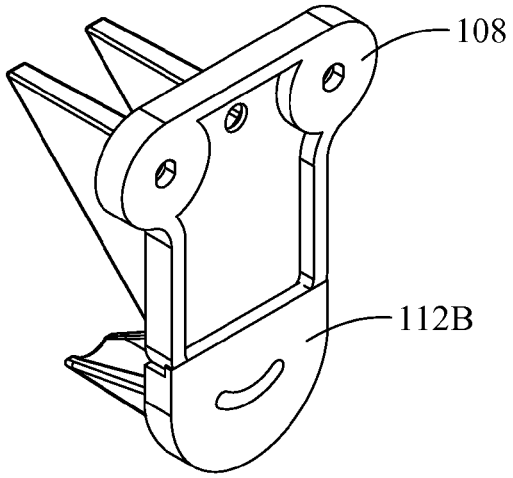
FIG. 30 is an upper back perspective view of the end bracket and interchangeable piece shown in FIG. 28.
Figure 31:
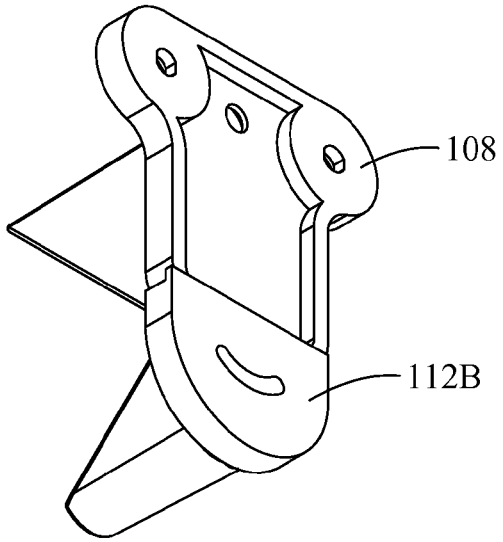
FIG. 31 is a lower back perspective view of the end bracket and interchangeable piece shown in FIG. 28.
Figure 32:
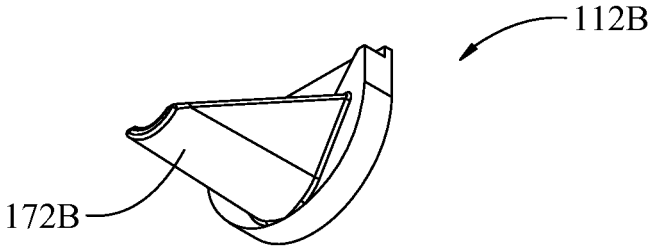
FIG. 32 is a lower front perspective view of the interchangeable piece shown in FIG. 26.

As shown in FIG. 27, the interchangeable piece 112B does not include a recessed back portion. In other embodiments, the interchangeable piece may include a back portion that is recessed (see, for example, FIG. 19).

In the illustrated embodiment of FIGS. 32 through 39, the saddle or cradle portion 172B of the interchangeable piece 112B has a generally C-shaped or U-shaped profile when viewed from the end thereof. Accordingly, the saddle or cradle portion 172B is suitable for receiving and support an end portion of a hang rod having a circular cross section. In other embodiments, the saddle or cradle portion 172B may have a different configuration (e.g., different shape, different profile, different size, etc.) depending, for example, on the corresponding cross-sectional shape or size of the hang/hanger rod 116B to be supported thereby.

The third interchangeable piece 112C will now be described in further detail with reference to FIGS. 46 through 53. The third interchangeable piece 112C includes pin 152C and groove 168C. The pin 152C is configured to be received within the end bracket's bottom hole 120, and groove 168C is configured for receiving the end bracket's nub 164.

The interchangeable piece 112C includes a notched portion or groove 174C complementary in shape to corresponding portions of the end bracket 108. The interchangeable piece 112C also includes a recessed upper portion 176C disposed generally within or interior to the groove 174C. The recessed upper portion 176C is shaped complementary to the lower rounded portion 148 of the end bracket 108. As shown in FIGS. 40 through 45, these complementary-shaped features allow the interchangeable piece 112C to be coupled to the end bracket 108 such that their back surfaces are flush or substantially aligned. In addition, these corresponding complementary-shaped portions of the end bracket 108 and interchangeable piece 112C may also help the installer align the interchangeable piece 112C when coupling to the end bracket 108 (e.g., by inserting the end bracket's nub 164 into the curved groove or slot 168C of the interchangeable piece 112C and inserting the interchangeable piece's pin 168C into the end bracket's bottom hole 120, etc.).

Figure 47:
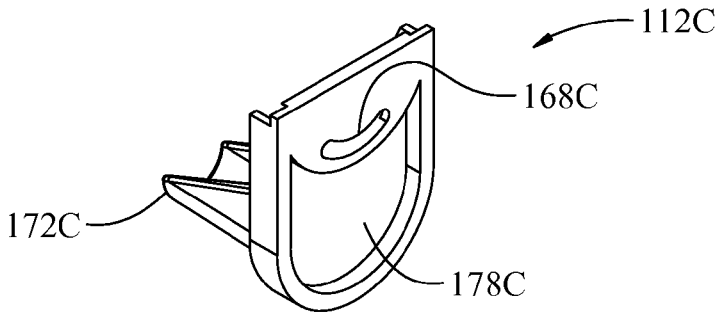
FIG. 47 is an upper back perspective view of the interchangeable piece shown in FIG. 46.
Figure 48:
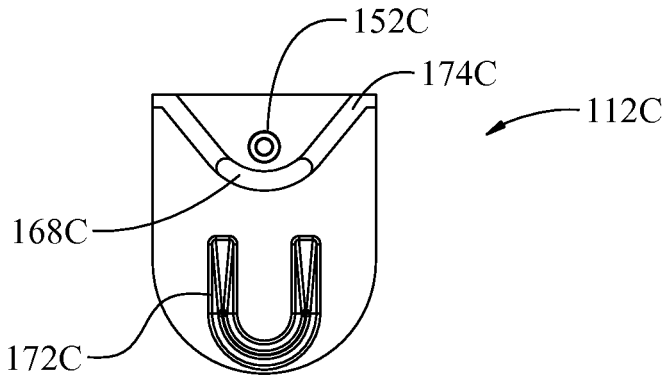
FIG. 48 is a front view of the interchangeable piece shown in FIG. 46.
Figure 49:
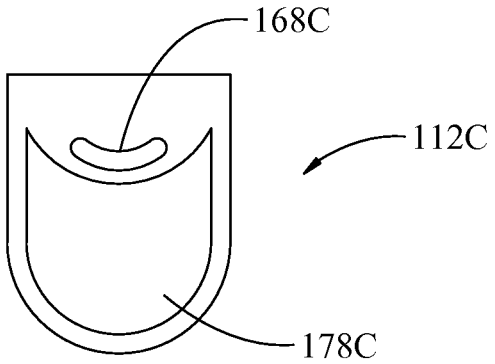
FIG. 49 is a back view of the interchangeable piece shown in FIG. 46.
Figure 50:
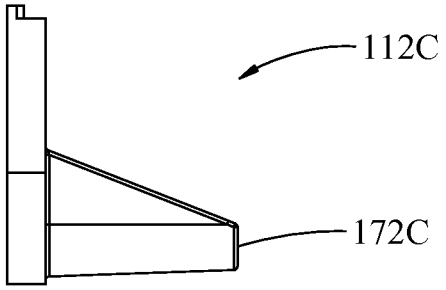
FIG. 50 is a left side view of the interchangeable piece shown in FIG. 46.
Figure 51:
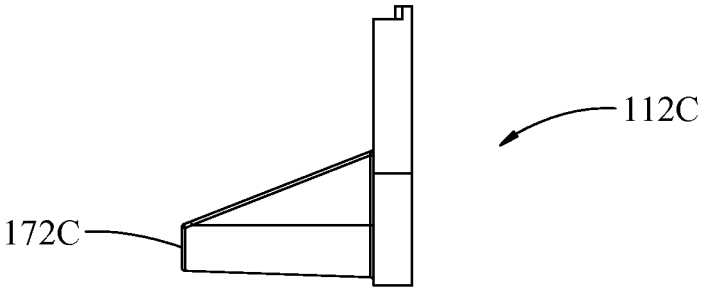
FIG. 51 is a right side view of the interchangeable piece shown in FIG. 46.
Figure 52:
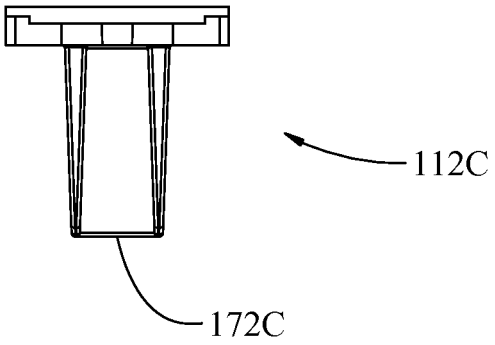
FIG. 52 is a top view of the interchangeable piece shown in FIG. 46.
Figure 53:
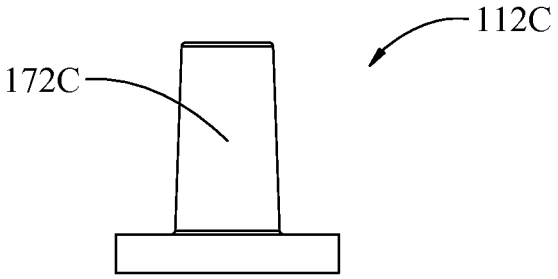
FIG. 53 is a back view of the interchangeable piece shown in FIG. 46.

As shown in FIG. 47, the interchangeable piece 112C includes a recessed back portion 178C. This allows less material to be used to form the interchangeable piece 112C. In other embodiments, the interchangeable piece may include a back portion that is not recessed (see, for example, FIG. 33).

In the illustrated embodiment of FIGS. 46 through 53, the saddle or cradle portion 172C of the interchangeable piece 112C has a generally C-shaped or U-shaped profile when viewed from the end thereof. Accordingly, the saddle or cradle portion 172C is suitable for receiving and support an end portion of a hang rod having a circular cross section. In other embodiments, the saddle or cradle portion 172C may have a different configuration (e.g., different shape, different profile, different size, etc.) depending, for example, on the corresponding cross-sectional shape or size of the hang/hanger rod 116C to be supported thereby.

With further regard to the illustrated embodiment of FIG. 1, the interchangeable pieces 112A, 112B, 112C have different top-to-bottom heights or lengths. In other embodiments, one or more of the interchangeable pieces may have the same length as another interchangeable piece.

The end brackets and interchangeable pieces may be constructed of the same material, different materials, or any suitable material, such as plastics, etc. In various exemplary embodiments, the end brackets and interchangeable pieces may be formed from polypropylene.

The hanger/hang rods may also be constructed of any suitable material, such as plastics, etc. In one exemplary embodiment, the hanger/hang rods may be hollow and formed from sheet metal.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A system relating to supporting a hang rod from a support surface, the system comprising:

a pair of end brackets; and a plurality of different pairs of interchangeable pieces configured to be selectively coupled to the pair of end brackets, whereby each pair of interchangeable pieces when selectively coupled to the end brackets, respectively, is operable for supporting a different hang rod from the support surface when the end brackets are coupled to the support surface;

a plurality of different hang rods each of which is capable of being supported from the support surface by a different pair of the plurality of different pairs of interchangeable pieces;

wherein:

the end brackets include shelf support surfaces extending outwardly from the end brackets;

the shelf support surfaces are defined by upper surfaces of generally triangular protections extending outwardly from the end brackets;

the different hang rods have different diameters; and each pair of interchangeable pieces include cradle portions compatible with the diameter of a corresponding one of the different hang rods.

2. A system relating to supporting a hang rod from a support surface, the system comprising:

a pair of end brackets; and a plurality of different pairs of interchangeable pieces configured to be selectively coupled to the pair of end brackets, whereby each pair of interchangeable pieces when selectively coupled to the end brackets, respectively, is operable for supporting a different hang rod from the support surface when the end brackets are coupled to the support surface;

wherein the end brackets include shelf support surfaces extending outwardly from the end brackets;

wherein the shelf support surfaces are defined by upper surfaces of generally triangular projections extending outwardly from the end brackets;

wherein at least one pair of interchangeable pieces includes cradle portions configured for supporting end portions of a hang rod at least partially within the cradle portions.

3. The system of claim 2, wherein:

each end bracket has an identical configuration suitable for use as a common end bracket such that any one of the interchangeable pieces may be coupled thereto; and each pair of the plurality of different pairs of interchangeable pieces includes two interchangeable pieces identical to each other.

4. The system of claim 2, wherein:

the interchangeable pieces include pins engageable within corresponding holes of the end brackets;

the interchangeable pieces include portions engageable within corresponding notches of the end brackets; and the end brackets include nubs engageable within corresponding grooves of the interchangeable pieces; and the end brackets include lower portions engagable within complementary-shaped recessed portions of the interchangeable pieces.

5. A system relating to supporting a hang rod from a support surface, the system comprising:

a pair of end brackets; and a plurality of different pairs of interchangeable pieces configured to be selectively coupled to the pair of end brackets, whereby each pair of interchangeable pieces when selectively coupled to the end brackets, respectively, is operable for supporting a different hang rod from the support surface when the end brackets are coupled to the support surface;

wherein the end brackets include lower portions engageable within complementary-shaped recessed portions and grooves of the interchangeable pieces, such that the back surface of the interchangeable piece is flush and substantially aligned with the back surface of the corresponding end bracket to which it is coupled.

6. The system of claim 5, wherein the end brackets include shelf support surfaces extending outwardly from the end brackets.

7. The system of claim 6, wherein the shelf support surfaces are defined by upper surfaces of generally triangular projections extending outwardly from the end brackets.

8. The system of claim 6, further comprising a shelf supportable on the shelf support surfaces of the end brackets.

* * * * *